US010048639B2

(12) United States Patent
Lee et al.

(10) Patent No.: US 10,048,639 B2
(45) Date of Patent: Aug. 14, 2018

(54) UNIDIRECTIONAL CLUTCH AND ELECTROPHOTOGRAPHIC IMAGE FORMING APPARATUS EMPLOYING THE SAME

(71) Applicant: S-PRINTING SOLUTION CO., LTD., Suwon-si, Gyeonggi-do (KR)

(72) Inventors: Chang-woo Lee, Suwon-si (KR); Han-jun Lee, Suwon-si (KR)

(73) Assignee: S-PRINTING SOLUTION CO., LTD., Suwon-si (KR)

( * ) Notice: Subject to any disclaimer, the term of this patent is extended or adjusted under 35 U.S.C. 154(b) by 0 days.

(21) Appl. No.: 15/647,916

(22) Filed: Jul. 12, 2017

(65) Prior Publication Data

US 2018/0039220 A1 Feb. 8, 2018

(30) Foreign Application Priority Data

Aug. 8, 2016 (KR) ..... 10-2016-0100885

(51) Int. Cl.

| | |
|---|---|
| ***G03G 15/00*** | (2006.01) |
| ***G03G 21/18*** | (2006.01) |
| ***G03G 21/16*** | (2006.01) |
| ***G03G 15/08*** | (2006.01) |

(52) U.S. Cl.

CPC ..... *G03G 15/757* (2013.01); *G03G 15/0879* (2013.01); *G03G 15/751* (2013.01); *G03G 21/1647* (2013.01); *G03G 21/1803* (2013.01); *G03G 21/186* (2013.01); *G03G 21/1857* (2013.01); *G03G 2221/1657* (2013.01)

(58) Field of Classification Search

CPC ..... F16D 41/00

See application file for complete search history.

(56) References Cited

U.S. PATENT DOCUMENTS

| | | | | |
|---|---|---|---|---|
| 6,189,666 | B1 * | 2/2001 | Willmot | F16D 41/00 192/46 |
| 6,338,402 | B1 | 1/2002 | Muramatsu et al. | |
| 6,712,188 | B2 | 3/2004 | Ando | |
| 6,938,745 | B2 | 9/2005 | Ohishi et al. | |
| 7,080,721 | B2 | 7/2006 | Yamamoto et al. | |

(Continued)

FOREIGN PATENT DOCUMENTS

| | | |
|---|---|---|
| KR | 0183069 | 4/1999 |
| KR | 10-0532843 | 12/2005 |

(Continued)

*Primary Examiner* — Clayton E Laballe
*Assistant Examiner* — Jas Sanghera
(74) *Attorney, Agent, or Firm* — Staas & Halsey LLP

(57) ABSTRACT

An unidirectional clutch including: a first rotating member including an accommodation portion; a second rotating member provided on a same axis as the first rotating member and including a latch portion; and a latch member including a latch arm and accommodated in the accommodation portion so as to pivot to a locking position, wherein the latch arm is caught at the latch portion, or to a releasing position, wherein the latch arm is released from the latch portion, according to a rotation direction of the first rotating member, wherein the latch member does not rotate in the accommodation portion, and a location of a pivot center of the latch member changes when pivoting to the locking position or to the releasing position.

20 Claims, 13 Drawing Sheets

(56) References Cited

U.S. PATENT DOCUMENTS

| | | | | |
|---|---|---|---|---|
| 7,185,747 | B2 | 3/2007 | Cha | |
| 7,214,161 | B2 | 5/2007 | Jinbo | |
| 8,702,556 | B2 | 4/2014 | Jimbo | |
| 2002/0195306 | A1 | 12/2002 | Ando et al. | |
| 2006/0165423 | A1* | 7/2006 | Nishitani ..... | G03G 15/0121 399/27 |

FOREIGN PATENT DOCUMENTS

| | | |
|---|---|---|
| KR | 10-0560300 | 3/2006 |
| KR | 10-0864302 | 10/2008 |
| KR | 10-1188957 | 10/2012 |

* cited by examiner

UNIDIRECTIONAL CLUTCH AND ELECTROPHOTOGRAPHIC IMAGE FORMING APPARATUS EMPLOYING THE SAME

CROSS-REFERENCE TO RELATED APPLICATION

This application claims the benefit of Korean Patent Application No. 10-2016-0100885, filed on Aug. 8, 2016, in the Korean Intellectual Property Office, the disclosure of which is incorporated herein in its entirety by reference.

BACKGROUND

1. Field

One or more embodiments relate to a unidirectional clutch and an electrophotographic image forming apparatus employing the same.

2. Description of the Related Art

An apparatus driven by rotary power of a motor (driving source), such as an image forming apparatus, may require an apparatus for selectively transmitting the rotary power of the motor to a driven body depending on a rotation direction.

A unidirectional clutch is an apparatus for transmitting, to the driven body, only rotary power in any one of a forward direction and a reverse direction from the driving source. The unidirectional clutch may have any one of various structures, such as a structure using a planet gear, a structure employing a clutch hub moving in an axial direction, and a structure using friction.

In an apparatus having a small driver, such as an image forming apparatus, a space occupied by the unidirectional clutch may be restricted. Accordingly, a unidirectional clutch capable of transmitting stable driving power within the restricted space is required.

SUMMARY

One or more embodiments include a unidirectional clutch capable of transmitting stable driving power, and an image forming apparatus employing the same.

Additional aspects will be set forth in part in the description which follows and, in part, will be apparent from the description, or may be learned by practice of the presented embodiments.

According to one or more embodiments, a unidirectional clutch includes: a first rotating member including an accommodation portion; a second rotating member provided on a same axis as the first rotating member and including a latch portion; and a latch member including a latch arm and accommodated in the accommodation portion so as to pivot to a locking position, wherein the latch arm is caught at the latch portion, or to a releasing position, wherein the latch arm is released from the latch portion, according to a rotation direction of the first rotating member, wherein the latch member does not rotate in the accommodation portion, and a location of a pivot center of the latch member changes when pivoting to the locking position or to the releasing position.

According to one or more embodiments, an electrophotographic image forming apparatus includes: a plurality of developer cartridges in which a developer is accommodated; a plurality of developing devices receiving the developer from the plurality of developer cartridges; a plurality of developer supply units supplying the developer from the plurality of developer cartridges to the plurality of developing devices; a motor; the first unidirectional clutch above including a first rotating member connected to the motor, and a second rotating member connected to one of the plurality of developer supply units; the second unidirectional clutch above including a first rotating member connected to the motor, and a second rotating member connected to another one of the plurality of developer supply units; and a rotation direction changing member disposed between the first rotating member of the second unidirectional clutch and the motor to change a rotation direction of the motor and transfer the changed rotation direction to the first rotating member of the second unidirectional clutch.

BRIEF DESCRIPTION OF THE DRAWINGS

These and/or other aspects will become apparent and more readily appreciated from the following description of the embodiments, taken in conjunction with the accompanying drawings in which:

FIGS. 2 and 3 are plan views of a unidirectional clutch according to an embodiment, wherein FIG. 2 shows a state in which a latch member is in a releasing position, and FIG. 3 shows a state in which the latch member is in a locking position;

FIGS. 4 and 5 are plan views of a unidirectional clutch according to another embodiment, wherein FIG. 4 shows a state in which a latch member is in a releasing position, and FIG. 5 shows a state in which the latch member is in a locking position;

FIGS. 6 and 7 are plan views of a unidirectional clutch according to another embodiment, wherein FIG. 6 shows a state in which a latch member is in a releasing position, and FIG. 7 shows a state in which the latch member is in a locking position;

DETAILED DESCRIPTION

Figure 1:
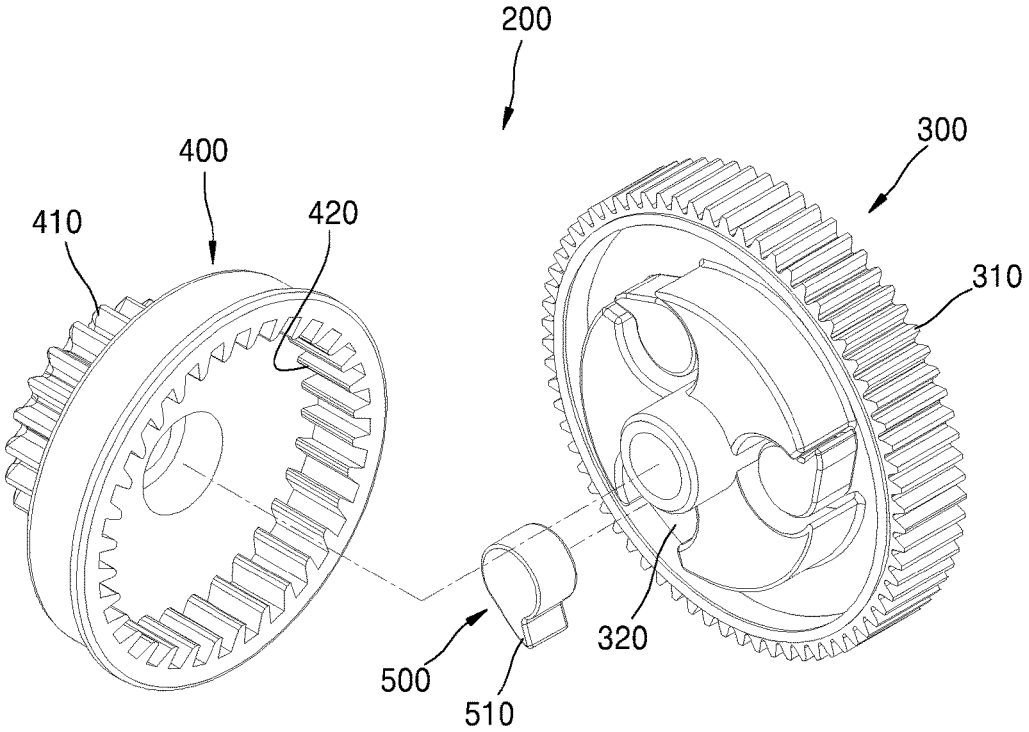
FIG. 1 is an exploded perspective view of a unidirectional clutch according to an embodiment.

Reference will now be made in detail to embodiments, examples of which are illustrated in the accompanying drawings, wherein like reference numerals refer to like elements throughout. In this regard, the present embodiments may have different forms and should not be construed as being limited to the descriptions set forth herein. Accordingly, the embodiments are merely described below, by referring to the figures, to explain aspects of the present description. As used herein, the term "and/or" includes any and all combinations of one or more of the associated listed items.

FIG. 1 is an exploded perspective view of a unidirectional clutch 200 according to an embodiment. Referring to FIG. 1, the unidirectional clutch 200 includes a first rotating member 300, a second rotating member 400, and a latch member 500. The first rotating member 300 is connected to a driving unit (not shown) to be rotated. For example, the first rotating member 300 may be connected to the driving unit via a gear connection structure. In this regard, the first rotating member 300 may include a gear portion 310 connected to the driving unit. For example, the first rotating member 300 may be connected to the driving unit via a belt connection structure. For example, the first rotating member 300 may be connected to the driving unit via an axial coupling structure.

The second rotating member 400 is provided on the same axis as the first rotating member 300. The second rotating member 40 may rotate in the same direction as the first rotating member 300 by being selectively connected to the first rotating member 300 according to a rotation direction of the first rotating member 300. The second rotating member 400 includes a latch portion 420 to be selectively connected to the first rotating member 300. The second rotating member 400 may be connected to a driven body (not shown). For example, the second rotating member 400 may be connected to the driven body via a gear connection structure, In this regard, the second rotating member 400 may include a gear portion 410 connected to the driven body as shown in FIG. 1. For example, the second rotating member 400 may be connected to the driven body via a belt connection structure. For example, the second rotating member 400 may be connected to the driven body via an axial coupling structure.

Figure 2:
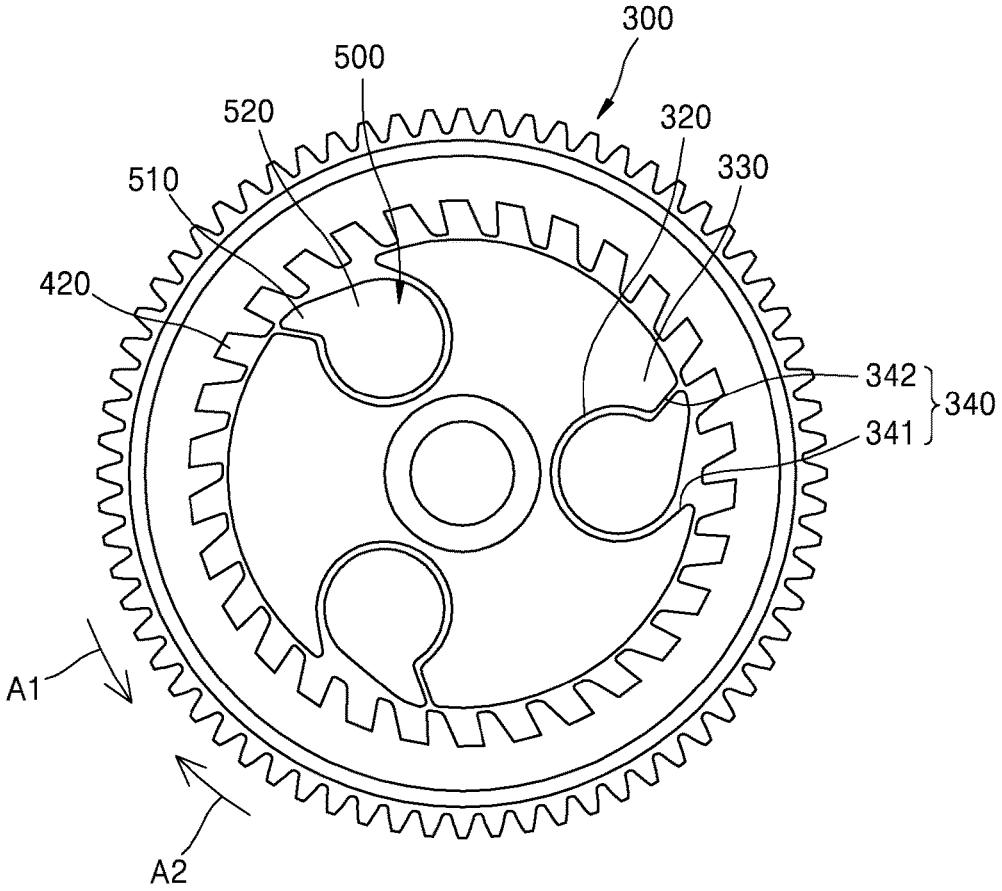
Figure 3:
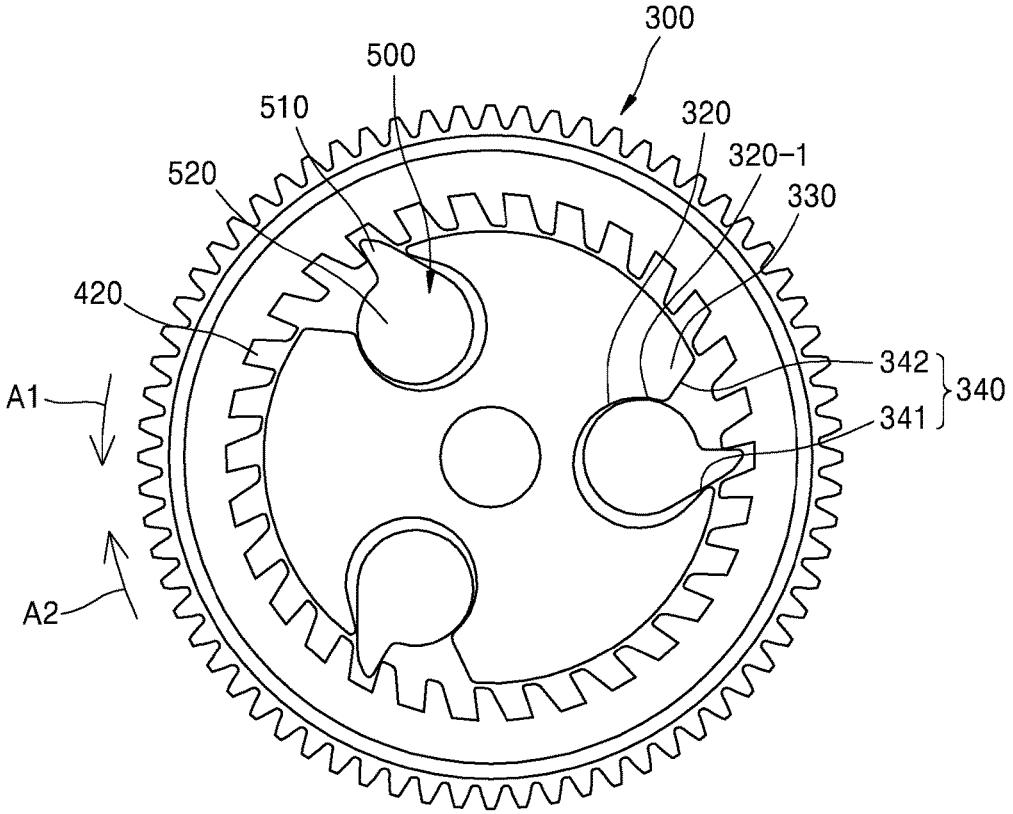

The latch member 500 is mounted in the first rotating member 300 to be selectively connected to the second rotating member 400 according to the rotation direction of the first rotating member 300. FIGS. 2 and 3 are plan views of the unidirectional clutch 200 according to an embodiment, wherein FIG. 2 shows a state in which the latch member 500 is in a releasing position, and FIG. 3 shows a state in which the latch member 500 is in a locking position. In FIGS. 2 and 3, only the latch portion 420 of the second rotating member 400 is illustrated.

Referring to FIGS. 1 through 3, the latch member 500 includes a latch arm 510. The latch member 500 is mounted in the first rotating member 300 so as to pivot to the locking position (FIG. 3), wherein the latch arm 510 is caught at the latch portion 420 of the second rotating member 400, or to the releasing position (FIG. 2), wherein the latch arm 510 is released from the latch portion 420. The latch member 500 pivots to the locking position or the releasing position according to the rotation direction of the first rotating member 300. For example, when the first rotating member 300 rotates in a first direction A1, the latch arm 510 is caught at the latch portion 420 and the second rotating member 400 rotates in the first direction A1 together with the first rotating member 300, and when the first rotating member 300 rotates in a second direction A2, the latch arm 510 is released from the latch portion 420 and the second rotating member 400 does not rotate.

The latch member 500 includes a body 520, and the latch arm 510 extends externally from the body 520. The first rotating member 300 includes a concave accommodation portion 320 accommodating the latch member 500. For example, the accommodation portion 320 may be defined by a wall 330 surrounding the accommodation portion 320. The wall 530 includes an opening 340 opened such that the latch arm 510 is caught at the latch portion 420 in the locking position. The body 520 may have, for example, a cylindrical shape, and the accommodation portion 320 may have a concave cylindrical shape including the opening 340.

One side wall of the opening 340, for example, a side wall 341 in the second direction A2, may operate as a support portion supporting the latch arm 510 such that the latch member 500 does not pivot over the locking position. When the first rotating member 300 starts to rotate in the first direction A1 from the state shown in FIG. 2, the latch member 500 slightly pivots in the second direction A2 according to inertia and centrifugal force. Then, an end portion of the latch arm 510 is caught at the latch portion 420. At this time, the second rotating member 400 does not rotate even when the first rotating member 300 continuously rotates in the first direction A1, and the latch member 500 further pivots in the second direction A2 such that the latch arm 510 is further caught at the latch portion 420. When the latch member 500 is in the locking position, the latch arm 510 is completely caught at the latch portion 420, as shown in FIG. 3, and at the same time, the latch arm 510 is supported by the side wall 341. Then, rotary power of the first rotating member 300 in the first direction A1 is transferred to the second rotating member 400 through the latch member 500, and the second rotating member 400 may rotate in the first direction A1 together with the first rotating member 300.

Another side wall of the opening 340, for example, a side wall 342 in the first direction A1, may operate as a stopper supporting the latch arm 510 such that the latch member 500 does not pivot over the releasing position. When the first rotating member 300 rotates in the second direction A2 from the state shown in FIG. 3, the latch portion 420 pushes the latch arm 510 such that the latch member 500 pivots towards the releasing position. Accordingly, the latch arm 510 is released from the latch portion 420 and pivots to the releasing position as shown in FIG. 2. When the latch member 500 reaches the releasing position, the latch arm 510 contacts the side wall 342. Accordingly, the latch member 500 does not pivot over the releasing position.

An opening width of the opening 340, i.e., a distance between the side walls 341 and 342, is determined such that the body 520 is not separated from the accommodation portion 320 through the opening 340.

The latch portion 420 may be continuously arranged in a circumferential direction. Three latch members 500 are shown in FIGS. 1 through 3, but the number of latch members 500 may be one or more. The latch portion 420 may be tilted in the first direction A1 with respect to a radial direction. At this time, when the first rotating member 300 rotates in the first direction A1, the latch arm 510 is naturally caught at the latch portion 420, and when the first rotating member 300 rotates in the second direction A2, the latch arm 510 is naturally released from the latch portion 420.

In the unidirectional clutch 200 according to the current embodiment, the latch member 500 does not rotate. In other words, when the first rotating member 300 rotates in the second direction A2, the latch member 500 revolves together with the first rotating member 300, but does not rotate with respect to the first rotating member 300. In a unidirectional clutch using a general planet gear, the general planet gear rotates when rotary power is not transferred. For rotation, the general planet gear includes gear teeth, and one of the gear teeth operates as a latch arm. In a miniaturized structure of the unidirectional clutch using the general planet gear, it is difficult to obtain mechanical strength of the latch arm which is one of the gear teeth because a size of the gear tooth is small. However, according to the current embodiment, since the latch member 500 does not rotate, a gear tooth is not required. Accordingly, since the large latch arm 510 may be formed with respect to the latch member 500 of the given size, mechanical strength of the latch arm 510 may be high, and thus rotary power may be stably transferred.

Also, in the unidirectional clutch 200 according to the current embodiment, a pivot center of the latch member 500 is not fixed. In other words, the pivot center moves when the latch member 500 pivots to the locking position or to the releasing position. Accordingly, a location of the pivot center may be different when the latch member 500 is in the locking position and when the latch member 500 is in the releasing position. In this regard, an inner diameter of the accommodation portion 320 may be greater than an outer diameter of the body 520.

When the location of the pivot center of the latch member 500 is fixed, for example, when the body 520 includes a pivot shaft and the accommodation portion 320 includes a pivot hole into which the pivot shaft is inserted, the rotary power of the first rotating member 300 is concentrated at the pivot shaft in the locking position. Accordingly, when a load is large, the pivot shaft may be damaged. Damage to the pivot shaft may be prevented by increasing the diameter of the pivot shaft, but since the size of the first rotating member 300 is small in the small unidirectional clutch 200, increasing the size of the pivot shaft may be limited.

According to the current embodiment, since the pivot center of the latch member 500 is not fixed, in the locking position, the latch arm 510 is supported by the side wall 341 and the body 520 is partially supported by a portion 320-1 of a wall 320 forming the accommodation portion 320, as shown in FIG. 3. In the locking position, since the rotary power of the first rotating member 300 is evenly provided to the body 520 and the latch arm 510, the latch member 500 may have stable mechanical strength. Accordingly, the small unidirectional clutch 200 may stably transfer large driving power to the second rotating member 400.

Also, since the pivot center of the latch member 500 is not fixed, the pivot shaft or the pivot hole is not required to be formed in the latch member 500 or the first rotating member 300, and thus shapes of the latch member 500 and first rotating member 300 may be simplified. A simplified shape of a component results in improving the degree of freedom of design, and thus the small unidirectional clutch 200 may be designed to have any one of various shapes for various devices. Also, assembly costs may be reduced because the latch member 500 simply needs to be inserted into the accommodation portion 320 during assembly.

Figure 4:
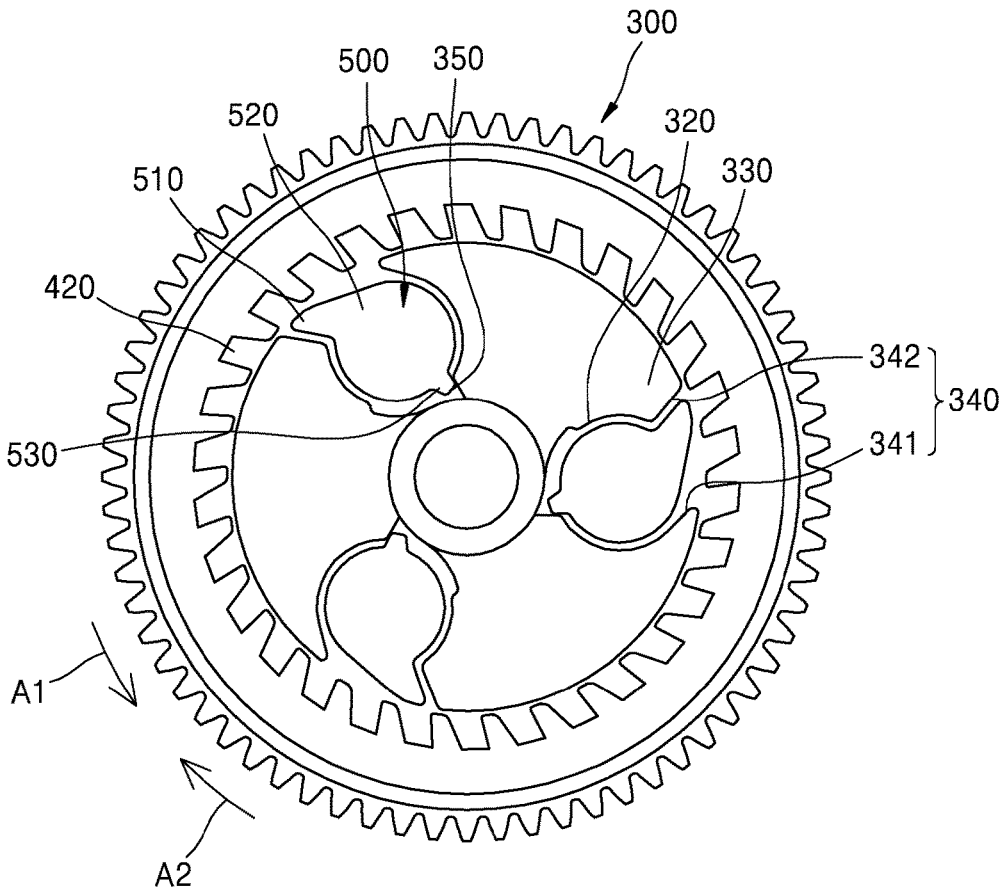
Figure 5:
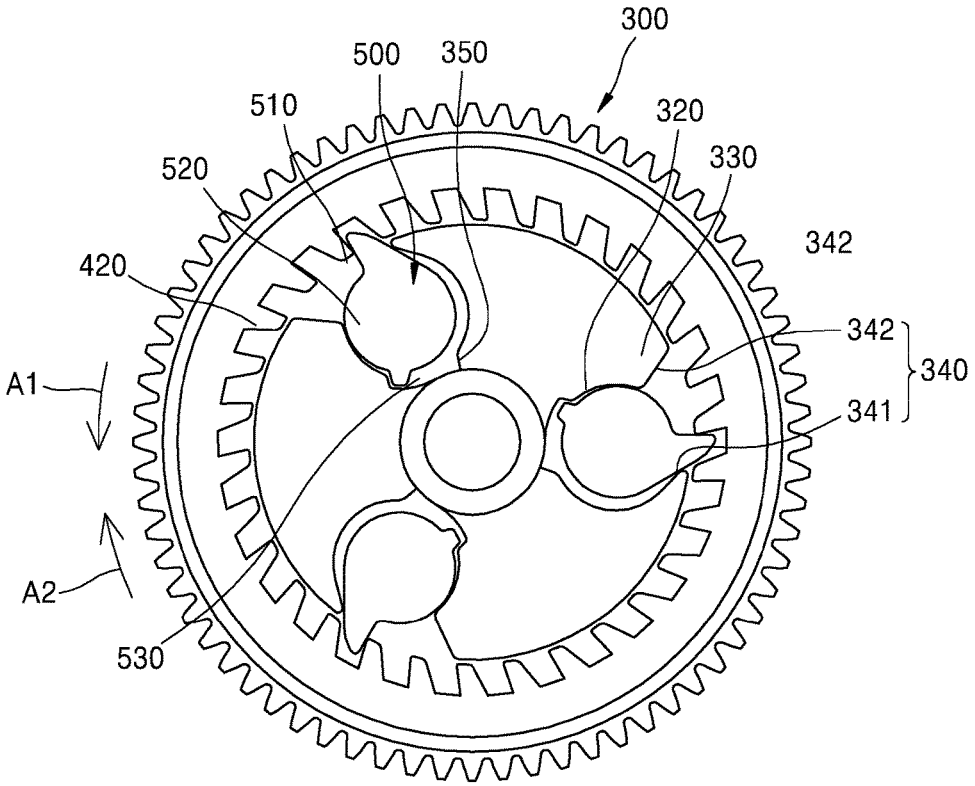

FIGS. 4 and 5 are plan views of the unidirectional clutch 200 according to another embodiment, wherein FIG. 4 shows a state in which the latch member 500 is in a releasing position, and FIG. 5 shows a state in which the latch member 500 is in a locking position. In FIGS. 4 and 5, only the latch portion 420 of the second rotating member 400 is illustrated. The unidirectional clutch 200 according to the current embodiment is different from that of FIGS. 2 and 3 in that the unidirectional clutch 200 according to the current embodiment includes an initial pivot portion for initially pivoting the latch member 500 in the releasing position to the locking position.

Referring to FIGS. 4 and 5, the initial pivot portion may include a protruding portion 530 protruding from the body 520 of the latch member 500, and a pushing portion 350 pushing the protruding portion 530 when the first rotating member 300 rotates in the first direction A1 so as to pivot the latch member 500 from the releasing position to the locking position. The pushing portion 350 is provided on the wall 320. In the releasing position, the protruding portion 530 may contact the pushing portion 350 as shown in FIG. 4, or may be slightly spaced apart from the pushing portion 350. At this time, when the first rotating member 300 starts to rotate in the first direction A1, the pushing portion 350 pushes the protruding portion 530 to initially pivot the latch member 500 to the locking position (in the second direction A2). Accordingly, the end portion of the latch arm 510 is stably caught at the latch portion 420. At this time, the second rotating member 400 no longer rotates even when the first rotating member 300 continuously rotates in the first direction A1, and the latch arm 510 is further caught at the latch portion 420 as the latch member 500 further pivots in the second direction A2. When the latch member 500 reaches the locking position, the latch arm 510 is completely caught at the latch portion 420 as shown in FIG. 5, and at the same time, the latch arm 510 is supported by the side wall 341. Then, the rotary power of the first rotating member 300 in the first direction A1 is transferred to the second rotating member 400 through the latch member 500, and the second rotating member 400 may rotate in the first direction A1 together with the first rotating member 300.

As such, by using the initial pivot portion, the latch member 500 may stably pivot to the locking position. Also, a delay time, i.e., backlash, between a rotation start time of the first rotating member 300 and a rotation start time of the second rotating member 400 may be reduced.

Figure 6:
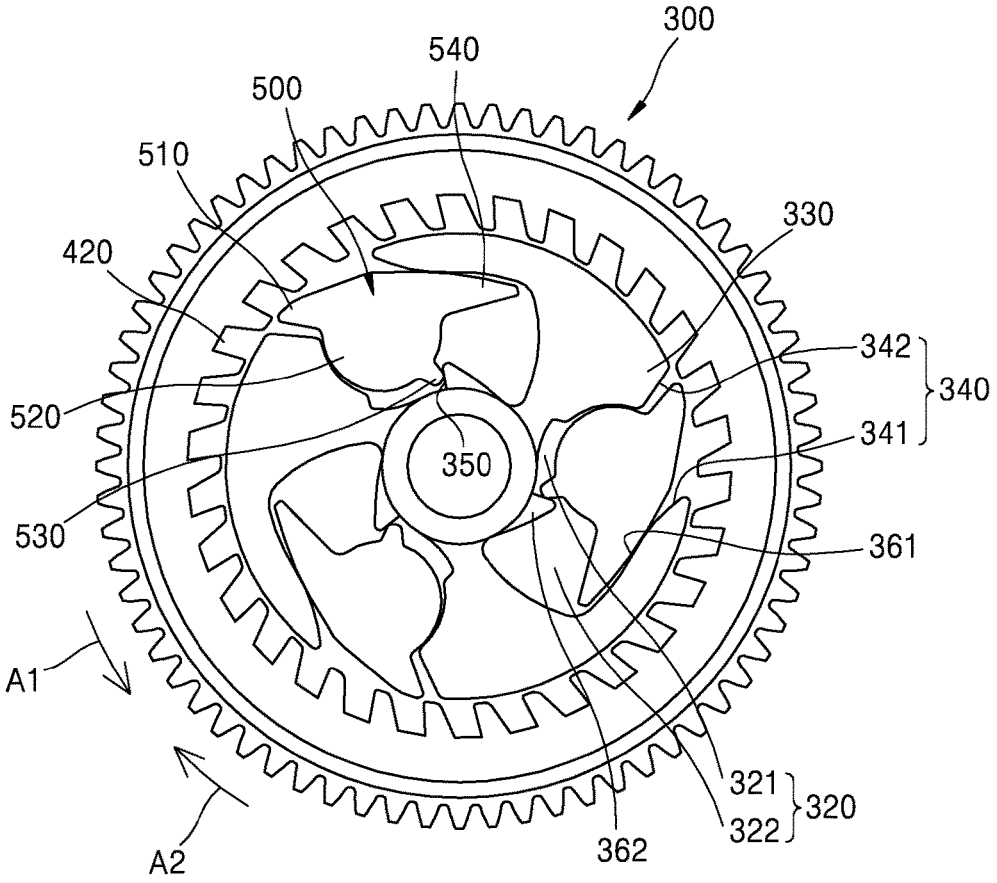
Figure 7:
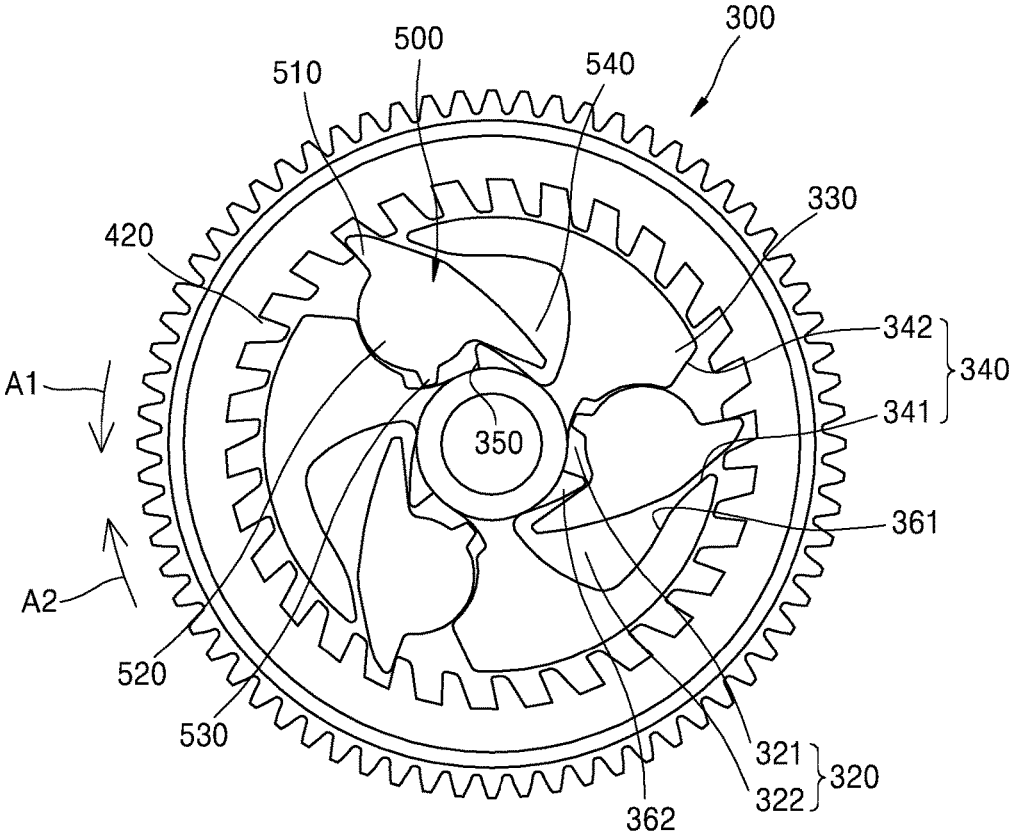

FIGS. 6 and 7 are plan views of the unidirectional clutch 200 according to another embodiment, wherein FIG. 6 shows a state in which the latch member 500 is in a releasing position, and FIG. 7 shows a state in which the latch member 500 is in a locking position. In FIGS. 6 and 7, only the latch portion 420 of the second rotating member 400 is illustrated. The unidirectional clutch 200 according to the current embodiment is different from that of FIGS. 4 and 5 in that the latch member 500 of the unidirectional clutch 200 according to the current embodiment further includes a support arm 540.

Referring to FIGS. 6 and 7, the latch member 500 further includes the support arm 540. The support arm 540 extends from the body 520 in a different direction from the latch arm 510. The accommodation portion 320 may include a first accommodation portion 321 pivotally accommodating the body 520, and a second accommodation portion 322 communicating with the first accommodation portion 321 and accommodating the support arm 540. The wall 330 defines the first and second accommodation portions 321 and 322 that are concave. The opening 340 is provided at the first accommodation portion 321. The wall 330 includes a stopper 361 that contacts the support arm 540 when the latch member 50 is in the releasing position such that the latch member 500 does not pivot over the releasing position. Also, the wall 330 includes a support portion 362 that supports the support arm 540 when the latch member 500 is in the locking position such that the latch member 500 does not pivot over the locking position.

Accordingly, since the latch member 500 is supported by the support arm 540 and the support portion 362 when the latch member 500 is in the locking position, the rotary power of the first rotating member 300 may be stably transferred to the second rotating member 400 through the latch member 500. Accordingly, the small unidirectional clutch 200 may stably transfer large driving power to the second rotating member 400.

The unidirectional clutch 200 of FIGS. 6 and 7 may also include the initial pivot portion, i.e., the protruding portion 530 and the pushing portion 350.

Figure 8:
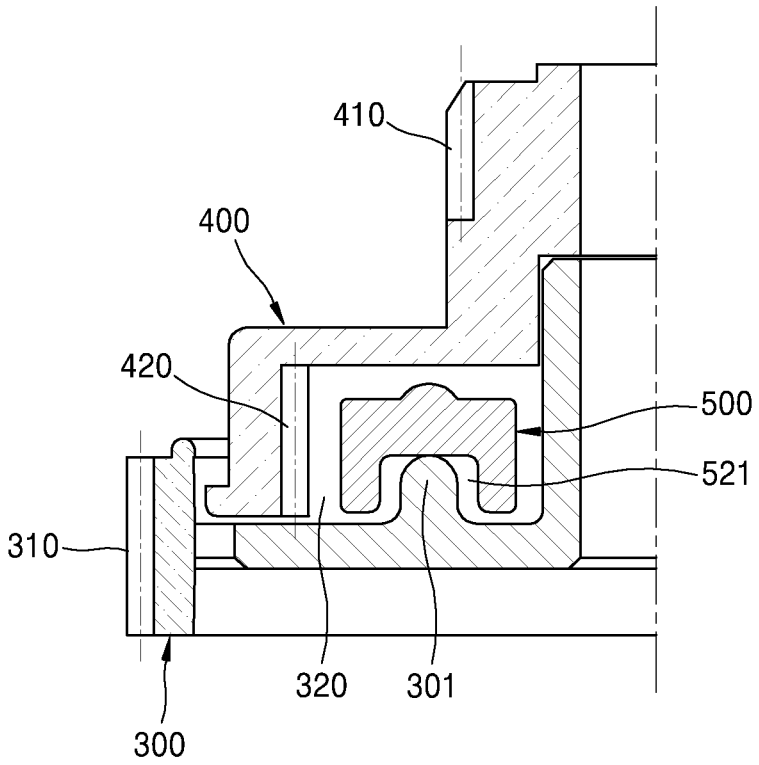
FIG. 8 is a partial cross-sectional view of a unidirectional clutch to which first and second reference portions are applied, according to an embodiment.

When, in FIGS. 2 to 7, the latch member 500 is inserted into the accommodation portion 320 in an opposite direction based on the axial direction, that is, when the latch member 500 is inserted into the accommodation portion 320 upside down, during assembly, the unidirectional clutch 200 malfunctions. Accordingly, as shown in FIG. 8, an assembly reference portion for properly inserting the latch member 500 into the accommodation portion 320 may be provided. Referring to FIG. 8, the body 520 of the latch member 500 includes a first reference portion 521. A second reference portion 301 having a complementary shape of the first reference portion 521 is provided at a bottom of the first rotating member 300, i.e., at a bottom of the accommodation portion 320. For example, the first reference portion 521 may have a shape concave from a bottom of the body 520, and the second reference portion 301 may have a convex shape. Here, the first and second reference portions 521 and 301 may be formed such that movement of the pivot center is not restricted when the latch member 500 pivots to the locking position or to the releasing position. For example, a diameter of the concave first reference portion 521 may be sufficiently larger than a diameter of the convex second reference portion 301.

Accordingly, the latch member 500 may be inserted into the accommodation portion 320 of the first rotating member 300 such that the first and second reference portions 521 and 301 are combined with each other. If the latch member 500 is inserted upside down, the latch member 500 protrudes upward by a protruding amount of the second reference portion 301 and the second rotating member 400 is not located at a proper location in the axial direction, and thus an operator is able to easily recognize an assembly error.

Figure 9:
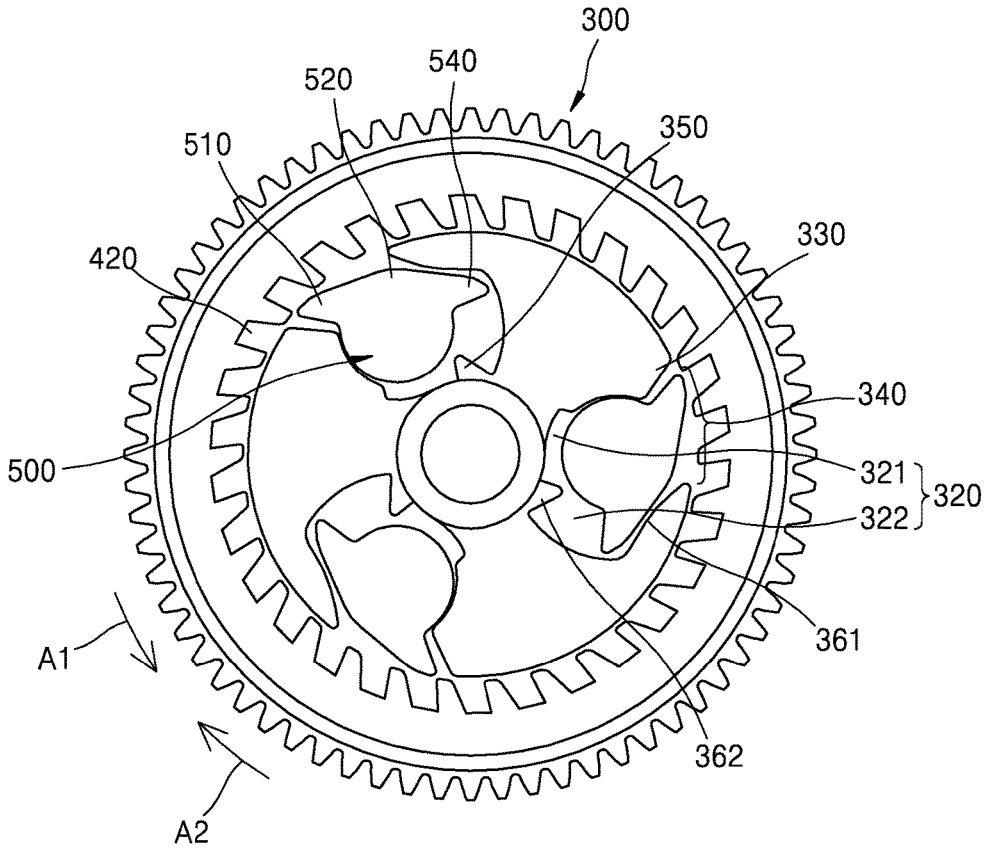
FIG. 9 is a plan view of a unidirectional clutch according to another embodiment, wherein a latch member is in a releasing position.

FIG. 9 is a plan view of the unidirectional clutch 200 according to another embodiment, wherein the latch member 500 is in a releasing position. In FIG. 9, only the latch portion 420 of the second rotating member 400 is illustrated. Referring to FIG. 9, in the unidirectional clutch 200 according to the current embodiment, the latch arm 510 and the support arm 540 of the latch member 500 have the same shape and are symmetrical with respect to the pivot center. Accordingly, the assembly reference portion is not required.

Figure 10:
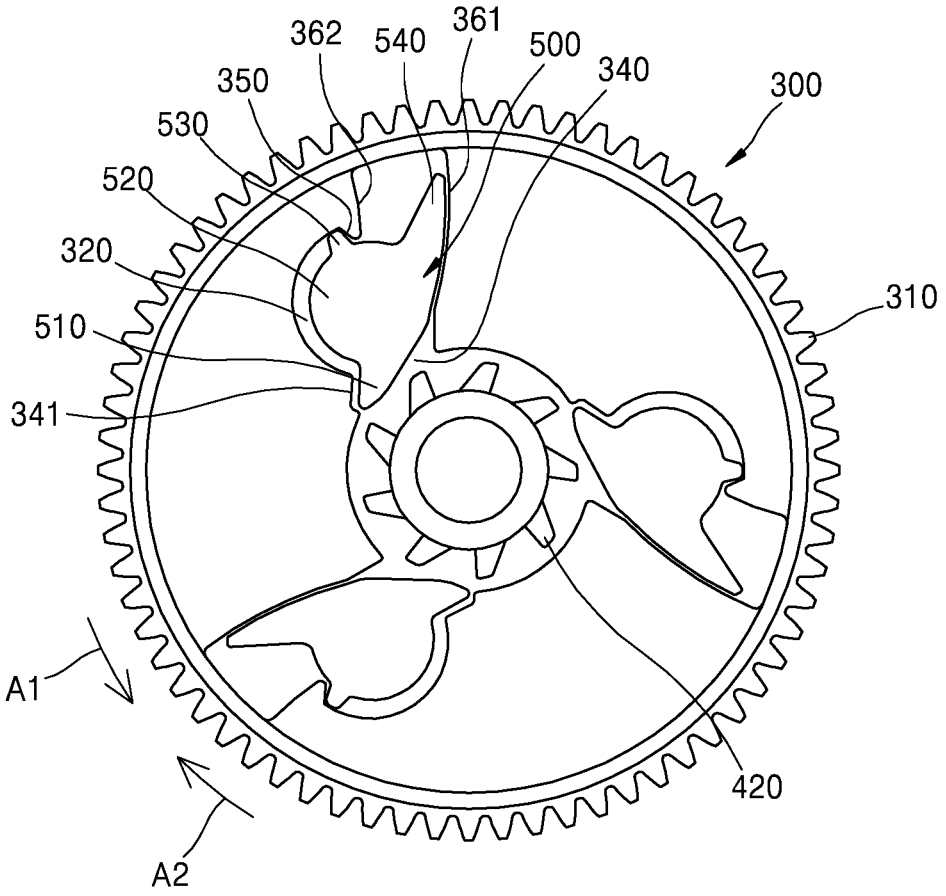
FIG. 10 is a plan view of a unidirectional clutch according to another embodiment, wherein a latch portion is located at an inner circumference and a latch member is located at an outer circumference.

In the embodiments shown in FIGS. 1 through 9, the latch member 500 is located at an inner circumference and the latch portion 420 is located at an outer circumference, but as shown in FIG. 10, the latch member 500 may be located at the outer circumference and the latch portion 420 may be located at the inner circumference.

Figure 11:
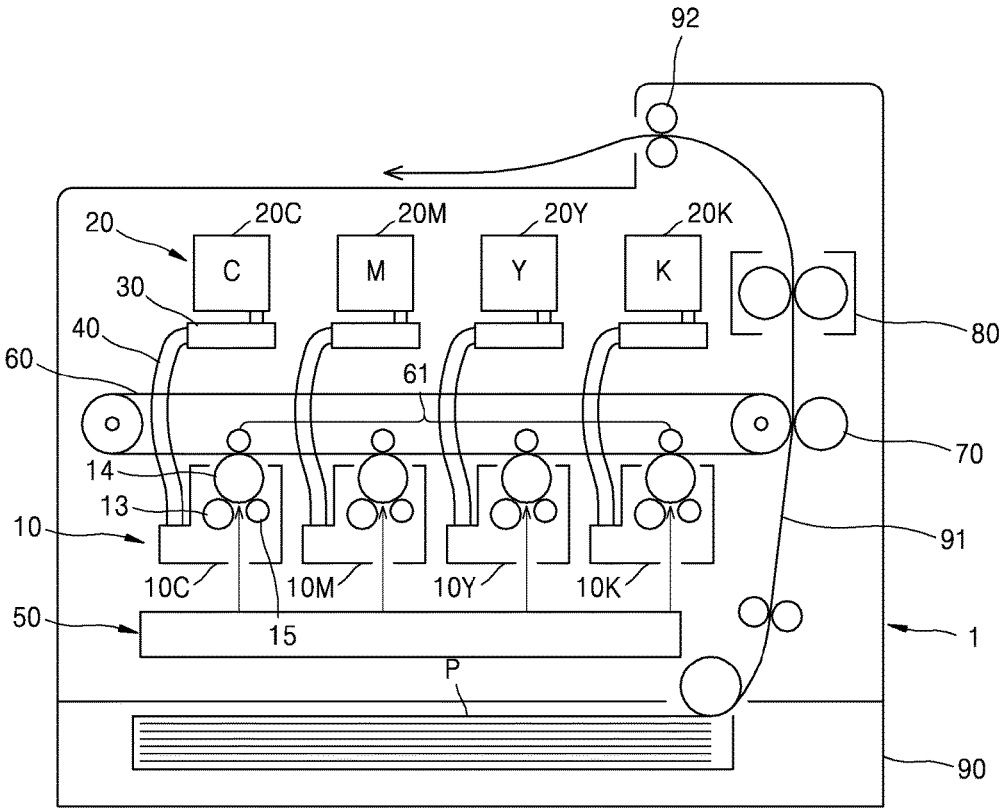
FIG. 11 is a diagram of an electrophotographic image forming apparatus according to an embodiment.

FIG. 11 is a diagram of an electrophotographic image forming apparatus 1 according to an embodiment. The electrophotographic image forming apparatus 1 according to the current embodiment prints a color image via electrophotography.

Referring to FIG. 11, the electrophotographic image forming apparatus 1 includes a plurality of developing devices 10 and a plurality of developer cartridges 20 in which developers are contained. The plurality of developer cartridges 20 are respectively connected to the plurality of developing devices 10, and the developers contained in the plurality of developer cartridges are supplied respectively to the plurality of developer devices 20. The plurality of developer cartridges 20 and the plurality of developing devices 10 may be individually replaced.

The plurality of developing devices 10 include developing devices 10C, 10M, 10Y, and 10K for respectively developing cyan (C), magenta (M), yellow (Y), and black (K) developers. Also, the plurality of developer cartridges 20 may include a plurality of developer accommodation portions 20C, 20M, 20Y, and 20K respectively accommodating C, M, Y, and K developers to be respectively supplied to the developing devices 10C, 10M, 10Y, and 10K. However, an embodiment is not limited thereto, and the developer cartridge 20 and the developing device 10 for accommodating and developing developers of various colors, such as light magenta and white, in addition to the above colors, may be used. Hereinafter, the electrophotographic image forming apparatus 1 including the developing devices 10C, 10M, 10Y, and 10K, and the developer accommodation portions 20C, 20M, 20Y, and 20K is described, and unless described otherwise, when C, M, Y, or K is added to a reference numeral, the reference numeral denotes a component for developing the C, M, Y, or K developer.

The developing device 10 may include a photoconductive drum 14 having a surface where an electrostatic latent image is formed, and a developing roller 13 developing a visible toner image by supplying the developer from the developing device 10 to the electrostatic latent image. The photoconductive drum 14 is an example of a photoreceptor having a surface where an electrostatic latent image is formed, and may include a conductive metal pipe and a photoconductive layer formed on an outer circumference of the conductive metal pipe. A charging roller 15 is an example of a charger that charges the photoconductive drum 14 to have uniform surface electric potential. A charging brush or a Corona charger may be used instead of the charging roller 15.

Although not shown in FIG. 11, the developing device 10 may further include a charging roller cleaner that removes impurities, such as a developer or dust, attached to the charging roller 15, a cleaning member that removes a developer remained on a surface of the photoconductive drum 14 after an intermediate transfer process described below, and a regulator that regulates an amount of the developer supplied to a developing region where the photoconductive drum 14 and the developing roller 13 face each other.

When a two-component developing method is used, the developer contained in the developer cartridge 20 may be toner. A carrier may be accommodated in the developing device 10. The developing roller 13 is separated from the photoconductive drum 14 by dozens to hundreds of microns. Although not shown in FIG. 11, the developing roller 13 may be a magnetic roller, and may be a structure in which a magnetic roller is provided in a developing sleeve. The toner and the carrier are mixed in the developing device 10, and the toner is attached to the surface of the magnetic carrier. The magnetic carrier is attached to a surface of the developing roller 13 and conveyed to the developing region where the photoconductive drum 14 and the developing roller 13 face each other. Only the toner is supplied to the photoconductive drum 14 by a developing bias voltage applied between the developing roller 13 and the photoconductive drum 14, and the electrostatic latent image formed on the surface of the photoconductive drum 14 is developed to a visible image.

When the two-component developing method is used, the developer contained in the developer cartridge 20 may be the toner and the carrier. In this case, in order to uniformly maintain proportions of the carrier and the toner in the developing device 10, the excessive carrier may be discharged to the outside of the developing device 10 and contained in a waste developer container (not shown).

When a one-component developing method, in which a carrier is not used, is used, the developing roller 13 may rotate by contacting the photoconductive drum 14, or may rotate while being separated from the photoconductive drum 14 by dozens to hundreds of microns. The developer contained in the developer cartridge 20 may be toner.

Although not shown in FIG. 11, the developing device 10 may further include cleaning member that removes waste toner remaining in the photoconductive drum 14 after a transfer process described below.

Hereinabove, a developing method of the electrophotographic image forming apparatus 1 has been described, but the developing method is not limited thereto and may be variously modified or changed.

An optical scanning unit 50 forms the electrostatic latent image on the photoconductive drum 14 by irradiating light modulated according to image information onto the photoconductive drum 14, and may be a laser scanning unit (LSU) using a laser diode as a light source, or a light-emitting diode (LED) scanning unit using an LED as a light source.

An intermediate transfer belt 60 temporarily accommodates a toner image developed on the photoconductive drum 14 of the developing devices 10C, 10M, 10Y, and 10K. A plurality of transfer rollers 61 are arranged facing the photoconductive drums 14 of the developing devices 10C, 10M, 10Y, and 10K with the intermediate transfer belt 60 provided therebetween. An intermediate transfer bias voltage is applied to the plurality of intermediate transfer rollers 61 to intermediately transfer an image developed on the photoconductive drum 14 to the intermediate transfer belt 60. A Corona transfer unit or a pin Scorotron transfer unit may be used instead of the intermediate transfer rollers 61.

A transfer roller 70 faces the intermediate transfer belt 60. A transfer bias voltage is applied to the transfer roller 70 to transfer the toner image transferred to the intermediate transfer belt 60 to a print medium P.

A fixing unit 80 fixes the toner image transferred to the print medium P on the print medium P by applying heat and/or pressure to the toner image. A shape of the fixing unit 80 is not limited to that shown in FIG. 11.

Accordingly, the optical scanning unit 50 forms electrostatic latent images on the photoconductive drums 14 by irradiating a plurality of lights modulated according to image information of each color to the photoconductive drums 14 of the developing devices 10C, 10M, 10Y, and 10K. The electrostatic latent images formed on the photoconductive drums 14 of the developing devices 10C, 10M, 10Y, and 10K are developed to visible toner images by the C, M, Y, and K developers supplied from the developer accommodation portions 20C, 20M, 20Y, and 20K to the developing devices 10C, 10M, 10Y, and 10K. The visible toner images are sequentially intermediately transferred to the intermediate transfer belt 60. The print medium P loaded in a paper-feeding tray 90 is conveyed along a paper-feeding path 91 and between the transfer roller 70 and the intermediate transfer belt 60. The visible toner image intermediately transferred on the intermediate transfer belt 60 by the transfer bias voltage applied to the transfer roller 70 is transferred to the print medium P. When the print medium P passes through the fixing unit 80, the visible toner image is fixed onto the print medium P by heat and pressure. The print medium P is then discharged by discharge rollers 92.

The developer contained in the developer cartridge 20 is supplied to the developing device 10. When the developer contained in the developer cartridge 20 is all used, the developer cartridge 20 may be replaced by a new developer cartridge or new developer may be filled in the developer cartridge 20.

A developer supply unit 30 receives the developer from the developer cartridge 20 and supplies the developer to the developing device 10. The developer supply unit 30 is connected to the developing device 10 by a supply duct 40.

Figure 12:
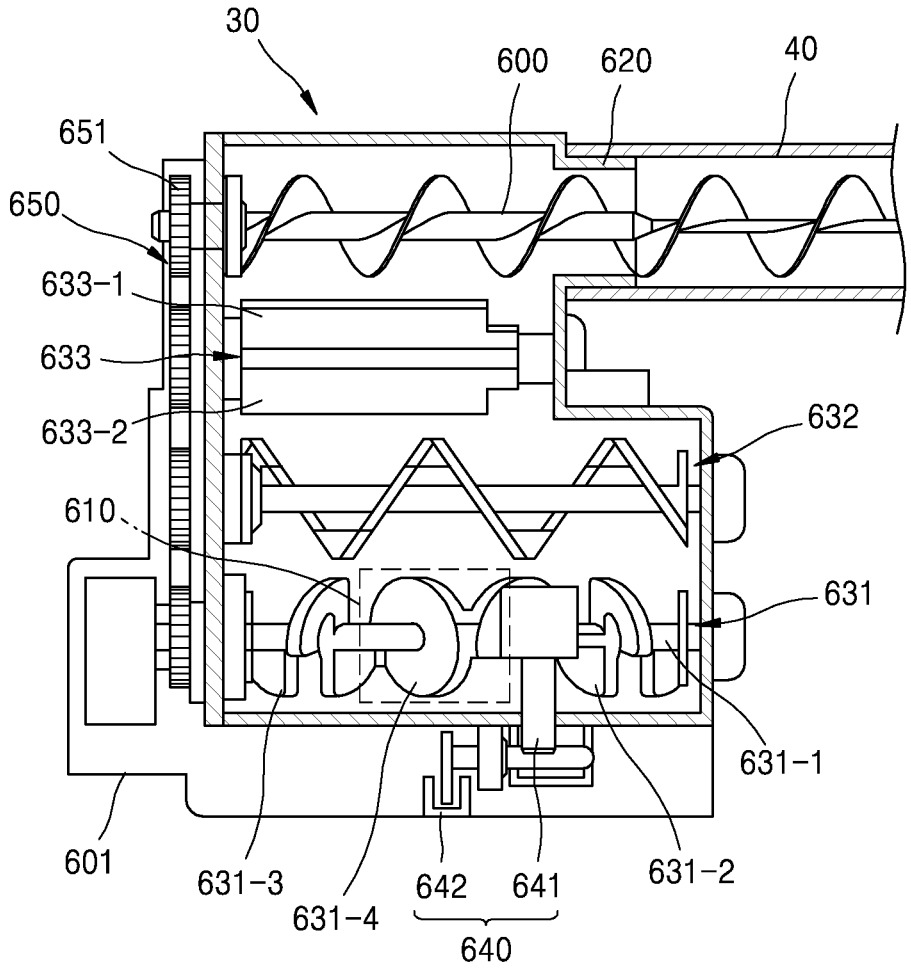
FIG. 12 is a plan view of a developer supplying unit according to an embodiment.

FIG. 12 is a plan view of the developer supplying unit 30 according to an embodiment. Referring to FIG. 12, the developer supply unit 30 may include an inlet portion 610 into which the developer flows from the developer cartridge 20, and an outlet portion 620 from which the developer is discharged to the developing device 10. The supply duct 40 is connected to the outlet portion 620.

The developer supply unit 30 includes a conveying member that conveys the developer that flowed in through the inlet portion 610 to the outlet portion 620. According to the current embodiment, three conveying members 631, 632, and 633 are provided from the inlet portion 610 to the outlet portion 620. The developer that flowed to the developer supply unit 30 from the developer cartridge 20 through the inlet portion 610 is conveyed to the outlet portion 620 by the conveying members 631, 632, and 633.

The conveying member 631 includes a rotation shaft 631-1, and spiral transport wings 631-2 and 631-3 that transport the developer in the axis direction. The spiral transport wings 631-2 and 631-3 have opposite spiral directions. Accordingly, when the conveying member 631 rotates, the developer gathers at a center portion 631-4 where the spiral transport wings 631-2 and 631-3 are connected to each other, and is pushed and conveyed to the conveying member 632. The conveying member 632 stirs the developer in the developer supply unit 30 to not agglomerate. The conveying member 633 conveys the developer in the developer supply unit 30 in the radial direction. In this regard, the conveying member 633 includes a rotation shaft 633-1, and a paddle-type transport wing 633-2 extending in the radial direction from the rotation shaft 633-1. The number and shape of conveying members are not limited to the ones illustrated in FIG.

The supply duct 40 is connected to the outlet portion 620 of the developer supply unit 30. For example, the outlet portion 620 protrudes from a housing 601 of the developer supply unit 30. A developer supply member 600 is mounted in the developer supply unit 30, and extends into the supply duct 40 through the outlet portion 620. The supply duct 40 may not have a linear shape, but may have a curved multi-curvature structure. Also, a cross-sectional shape of the supply duct 40 may not be uniform. Accordingly, the developer supply member 600 extending into the supply duct 40 may be flexible according to the shape of the supply duct 40.

The developer supply unit 30 may include a developer residual detecting unit 640. The developer residual detecting unit 640 detects a residual amount of the developer contained in the developer supply unit 30. Referring to FIG. 12, the developer residual detecting unit 640 includes an elevating member 641 that ascends or descends according to a level of the developer in the developer supply unit 30, and a sensor 642 detecting a location of the elevating member 641. For example, the sensor 642 may detect the location of the elevating member 641 via an optical sensor method using quantity of light changed according to the location of the elevating member 641, or a magnetic sensor method using strength of a magnetic field changed according to the location of the elevating member 641.

In order for the location of the elevating member 641 to reflect the level of the developer, the elevating member 641 needs to float on a surface of the developer contained in the developer supply unit 30. If toner piles up on the elevating member 641 and the elevating member 641 is buried by the developer, the location of the elevating member 641 is unable to reflect the level of the developer, and thus the residual amount of the developer is unable to be accurately detected. In this regard, the elevating member 641 may be periodically elevated by contacting a rotation cam (not shown) provided at the conveying member 641 when the conveying member 631 rotates. According to such an elevating operation, the developer piled up on the elevating member 641 may be removed, and the elevating member 641 buried by the developer may be located on the surface of the developer. Accordingly, the elevating member 641 may be located at the location reflecting the level of the developer at least for a certain period of time per one rotation cycle. A controller (not shown) may determine whether to supply the developer from the developer cartridge 20 to the developing device 10 based on a detected value of the level of the developer in the developer supply unit 30 and a detected value of a toner concentration sensor in the developer device 10. For example, the controller may determine whether to drive a developer supply motor (not shown) driving the developer supply unit 30 based on the detected value of the level of the developer in the developer supply unit 30 and the detected value of the toner concentration sensor. Accordingly, an appropriate amount of developer is always contained in the developing device 10, and an image of stable quality may be printed.

The conveying members 631, 632, and 633 and the developer supply member 600 are driven by the developer supply motor. The conveying members 631, 632, and 633 and the developer supply member 600 are connected to each other by, for example, a gear connection structure 650. For example, when a gear 651 is driven by the developer supply motor, the conveying members 631, 632, and 633 and the developer supply member 600 may be driven by the gear connection structure 650.

Referring to FIG. 11, when the electrophotographic image forming apparatus 1 is a color image forming apparatus, four developer supply units 30 are required, and four developer supply motors are required to respectively drive the four developer supply units 30. If the number of developer supply motors is reduced, manufacturing costs of the electrophotographic image forming apparatus 1 may be reduced.

According to the current embodiment, four developer supply units 30 are driven by using two developer supply motors. In this regard, the unidirectional clutch 200 shown in FIGS. 1 through 10 is employed.

Figure 13:
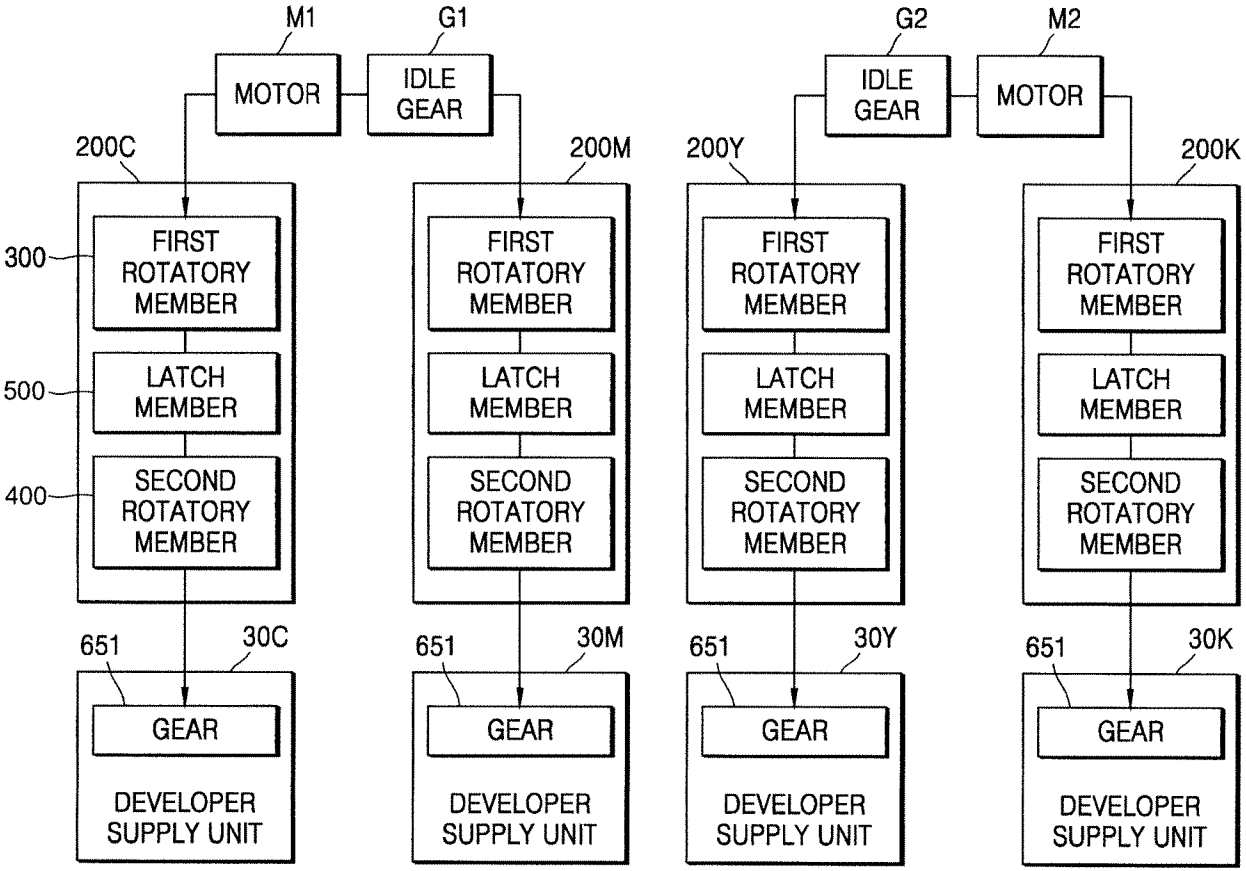
FIG. 13 is a block diagram of a developer supplying unit according to an embodiment.

FIG. 13 is a block diagram of the developer supplying unit 30 according to an embodiment. Two motors M1 and M2 and four unidirectional clutches 200C, 200M, 200Y, and 200K are illustrated in FIG. 13. The four unidirectional clutches 200C, 200M, 200Y, and 200K respectively correspond to developer supply units 30C, 30M, 30Y, and 30K. The unidirectional clutches 200C, 200M, 200Y, and 200K may be the structure shown in FIGS. 1 through 10.

The motor M1 is connected to the unidirectional clutches 200C and 200M. The first rotator member 300 of the unidirectional clutch 200C rotates in the first direction A1 and the second direction A2 respectively when the motor M1 rotates in a forward direction and a reverse direction. The unidirectional clutch 200C is connected to the developer supply unit 30C. In other words, the second rotating member 400 of the unidirectional clutch 200C is connected to the gear 651 of the developer supply unit 30C. The first rotating member 300 of the unidirectional clutch 200M rotates in the second direction A2 and the first direction A1 respectively when the motor M1 rotates in the forward direction and the reverse direction. Accordingly, an idle gear G1 is disposed between the motor M1 and the unidirectional clutch 200M. The idle gear G1 is a rotation direction changing member that changes the rotation direction of the motor M1 and transfers the changed rotation direction to the first rotating member 300 of the unidirectional clutch 200M. The unidirectional clutch 200M is connected to the developer supply unit 30M. In other words, the second rotating member 400 of the unidirectional clutch 200M is connected to the gear 651 of the developer supply unit 30M.

The motor M2 is connected to the unidirectional clutches 200Y and 200K. The first rotating member 300 of the unidirectional clutch 200K rotates in the first direction A1 and the second direction A2 respectively when the motor M2 rotates in a forward direction and a reverse direction. The unidirectional clutch 200K is connected to the developer supply unit 30K. In other words, the second rotating member 400 of the unidirectional clutch 200K is connected to the gear 651 of the developer supply unit 30K. The first rotating member 300 of the unidirectional clutch 200Y rotates in the second direction A2 and the first direction A1 respectively when the motor M2 rotates in the forward direction and the reverse direction. In this regard, an idle gear G2 is disposed between the motor M2 and the unidirectional clutch 200Y. The idle gear G2 is a rotation direction changing member that changes the rotation direction of the motor M2 and transfers the changed rotation direction to the first rotating member 300 of the unidirectional clutch 200Y. The unidirectional clutch 200Y is connected to the developer supply unit 30Y. In other words, the second rotating member 400 of the unidirectional clutch 200Y is connected to the gear 651 of the developer supply unit 30Y.

Accordingly, when the motor M1 rotates in the forward direction, the developer supply unit 30C is driven, and when the motor M1 rotates in the reverse direction, the developer supply unit 30M is driven. Also, when the motor M2 is driven in the forward direction, the developer supply unit 30K is driven, and when the motor M2 rotates in the reverse direction, the developer supply unit 30Y is driven.

Accordingly, the four developer supply units 30 may be driven by employing the two motors M1 and M2, and manufacturing costs of the electrophotographic image forming apparatus 1 may be reduced.

According to a unidirectional clutch and an electrophotographic image forming apparatus using the unidirectional clutch, according to one or more embodiments, rotation driving power in one direction may be stably transferred to a driven body. Also, the unidirectional clutch may be applied to a plurality of developer supply units so as to reduce manufacturing costs of the electrophotographic image forming apparatus.

While one or more embodiments have been described with reference to the figures, it will be understood by those of ordinary skill in the art that various changes in form and details may be made therein without departing from the spirit and scope of the disclosure as defined by the following claims.

What is claimed is:

1. A unidirectional clutch for an image forming apparatus comprising:

a first rotating member including an accommodation portion;

a second rotating member provided on the first rotating member so that the first rotating member and the second rotating member are in line with an axis, the second rotating member including a latch portion; and a latch member including:

a body accommodated in the accommodation portion, the body pivotable so that a pivot center of the body is changeable within the accommodation portion when pivoting to a locking position or a releasing position, and a latch arm extended from the body, the latch member pivotable to the locking position where the latch arm is caught at the latch portion, or to the releasing position where the latch arm is released from the latch portion, according to a rotation direction of the first rotating member, wherein pivoting of the latch member is caught in the accommodation portion with respect to the first rotating member when the latch member is in the locking position or in the releasing position.

2. The unidirectional clutch of claim 1, wherein, when the first rotating member rotates in a locking direction of the rotation direction, the latch member pivots to the locking position so that the second rotating member rotates together with the first rotating member in the locking direction, and when the first rotating member rotates in a releasing direction of the rotation direction, the latch member pivots from the locking position to the releasing position so that the second rotating member is released from rotating together with the first rotating member in the releasing direction.

3. The unidirectional clutch of claim 2, wherein, when the first rotating member rotates in the releasing direction, the latch member pivots from the locking position to the releasing position as the latch arm is pushed by the latch portion.

4. The unidirectional clutch of claim 3, wherein the latch member comprises a protruding portion, and the accommodation portion comprises a pushing portion to initially pivot the latch member from the releasing position to the locking position by pushing the protruding portion when the first rotating member starts to rotate in the locking direction.

5. The unidirectional clutch of claim 3, wherein the latch arm extending from the body is to be caught at the latch portion in the locking position, the first rotating member includes a wall defining the accommodation portion and surrounding the body, and the latch member having an opening formed in the wall, the opening having a first side wall and a second side wall such that the latch arm is caught at the latch portion in the locking position.

6. The unidirectional clutch of claim 5, wherein, in the releasing position, the latch arm maintains the releasing position by contacting the first side wall of the opening when the first rotating member rotates in the locking direction.

7. The unidirectional clutch of claim 5, wherein, in the locking position, the latch arm maintains the locking position by contacting the second side wall of the opening when the first rotating member rotates in the releasing direction.

8. The unidirectional clutch of claim 7, wherein, in the locking position, a part of the body contacts a part of the wall.

9. The unidirectional clutch of claim 5, wherein the body includes a protruding portion, and the wall includes a pushing portion to initially pivot the latch member from the releasing position to the locking position by pushing the protruding portion when the first rotating member starts to rotate in the locking direction.

10. The unidirectional clutch of claim 3, wherein the latch arm extending from the body is to be caught at the latch portion in the locking position, and the latch member includes a support arm extending from the body in an opposite direction from the latch arm, and the accommodation portion includes a first accommodation portion pivotably accommodating the body, and a second accommodation portion communicating with the first accommodation portion and accommodating the support arm.

11. The unidirectional clutch of claim 10, wherein the first rotating member includes a wall defining the first accommodation portion and the second accommodation portion, and an opening formed in the wall such that the latch arm is caught at the latch portion in the locking position.

12. The unidirectional clutch of claim 11, wherein the wall comprises a stopper that maintains the latch member to be in the releasing position by contacting the support arm in the releasing position.

13. The unidirectional clutch of claim 11, wherein the wall comprises a support portion that maintains the latch member to be in the locking position by contacting the support arm in the locking position.

14. The unidirectional clutch of claim 11, wherein the body comprises a protruding portion, and the wall comprises a pushing portion to initially pivot the latch member from the releasing position to the locking position by pushing the protruding portion when the first rotating member starts to rotate in the locking direction.

15. The unidirectional clutch of claim 10, wherein the latch arm and the support arm have a same shape and are symmetrical based on a pivot center of the latch member.

16. An electrophotographic image forming apparatus comprising:

a plurality of developer cartridges in which a developer is accommodated, respectively;

a plurality of developing devices to respectively receive the developer from the plurality of developer cartridges;

a plurality of developer supply units to respectively supply the developer from the plurality of developer cartridges to the plurality of developing devices;

a motor;

a plurality of clutches to respectively transmit a driving power of the motor to the plurality of developer supply units, the plurality of clutches including:

a first unidirectional clutch, which is the unidirectional clutch as claimed in claim 1, the first unidirectional clutch comprising the first rotating member connected to the motor, and the second rotating member connected to one of the plurality of developer supply units; and a second unidirectional clutch which is the unidirectional clutch as claimed in claim 1 comprising the first rotating member connected to the motor, and the second rotating member connected to another one of the plurality of developer supply units; and a rotation direction changing member disposed between the first rotating member of the second unidirectional clutch and the motor to change a rotation direction of the motor and transfer the changed rotation direction to the first rotating member of the second unidirectional clutch.

17. The unidirectional clutch of claim 1, wherein the latch member further comprising a plurality of latch members.

18. The unidirectional clutch of claim 1, wherein the latch arm is located closer to the axis than the latch portion.

19. The unidirectional clutch of claim 1, wherein the latch portion is located closer to the axis than the latch arm.

20. A unidirectional clutch for an image forming apparatus, comprising:

a first rotating member including an accommodation portion;

a second rotating member placed on the first rotating member, the second rotating member including at a latch portion;

a latch member including a body accommodated in the accommodated portion, the body pivotable so that a pivot center of the body is changeable within the accommodation portion when pivoting to a locking position or a releasing position, and a latch arm extended from the latch body, wherein, the latch member is pivotable to the locking position where the latch member is engaged with the latching portion so that the first rotating member and the second rotating member rotates together, and wherein the latch member is pivotable to the releasing position where the latch member is disengaged with the latching portion so that the second rotating member does not rotate with the first rotating member.

* * * * *